US005078668A

United States Patent [19]

Endres

[11] Patent Number: 5,078,668

[45] Date of Patent: Jan. 7, 1992

[54] GARMENT PROTECTOR AND METHOD OF MAKING SAID PROTECTOR

[76] Inventor: Elizabeth Endres, P.O. Box 3677, Costa Mesa, Calif. 92626

[21] Appl. No.: 583,816

[22] Filed: Sep. 17, 1990

[51] Int. Cl.[5] ..... B31B 1/26

[52] U.S. Cl. ..... 493/243; 493/232; 493/935

[58] Field of Search ..... 493/231, 232, 237, 243, 493/405, 935; 112/440, 441, 262.1, 262.2

[56] References Cited

U.S. PATENT DOCUMENTS

| | | | |
|---|---|---|---|
| 2,103,092 | 12/1937 | Robinson | 112/262.2 |
| 4,116,116 | 9/1978 | Barnett | 493/935 |
| 5,009,633 | 4/1991 | Smaling | 493/935 |

*Primary Examiner*—James G. Smith
*Assistant Examiner*—Jack W. Lavinder
*Attorney, Agent, or Firm*—Plante, Strauss, Vanderburgh & Connors

[57] ABSTRACT

Disclosed is a method of making garment protector that is of high quality, having an envelope structure made of cloth fabric with an easy access opening in one of its sides covered by a flap member.

3 Claims, 5 Drawing Sheets

GARMENT PROTECTOR AND METHOD OF MAKING SAID PROTECTOR

BACKGROUND OF THE INVENTION

1. Field of the Invention

This invention relates to a garment protector, and particularly one that is of high quality, being made of cloth fabric, and having an easy access opening in one of its sides covered by a flap member.

2. Background Discussion

Garment covers currently in widespread use are made of plastic and some include a zipper that allows one to gain access to the inside of the envelope structure of the plastic cover. These plastic covers, however, have a short life span, they tear, attract dust, have a disagreeable odor, and can be dangerous to children who could become trapped within them and suffocate. Therefore, they do not adequately protect the garment and they are unclean. Generally, these plastic covers have the appearance of a cheap product which does not appeal to more affluent consumers. Moreover, the zippered cover must be opened to provide access to the interior of the envelope structure of the cover, and then closed when the garment is placed within the cover.

SUMMARY OF THE INVENTION

The objective of this invention is (i) to provide a high quality garment protector made of a cloth fabric material and (ii) to eliminate the use of zippers or similar closure devices.

The garment protector of this invention has several features, no single one of which is solely responsible for its desirable attributes. Without limiting the scope of this invention as expressed by the claims which follow, its more prominent features will now be discussed briefly. After considering this discussion, and particularly after reading the section of this application entitled, "DETAILED DESCRIPTION OF THE PREFERRED EMBODIMENTS," one will understand how the features of this invention provide its advantages, which include high quality construction, ease of use without the need to employ zippers or other closure devices, and it is safe for use around children because the fabric is porous allowing for ventilation.

The first feature of this invention is that it has an envelope structure made of a unitary piece of cloth fabric which is folded upon itself and sown together in accordance with the simplified manufacturing method of this invention.

The second feature of this invention is that one longitudinal side edge of the envelope structure is open, but covered by a flap member, which can be opened readily to allow a garment on a hanger to be placed inside and easily removed from the envelope structure.

The third feature of this invention is that preferably a sheer fabric is used so that one may see the garment contained within the envelope structure.

DESCRIPTION OF THE DRAWING

The preferred embodiments of this invention, illustrating all of its features, will now be discussed in detail. These embodiments depict the novel and non-obvious garment protector of this invention, and method of manufacturing this protector, shown in the accompanying drawing, which is for illustrative purposes only.

The drawing includes the following FIGURES, with like numerals indicating like parts.

DESCRIPTION OF THE PREFERRED EMBODIMENTS

Figure 1:
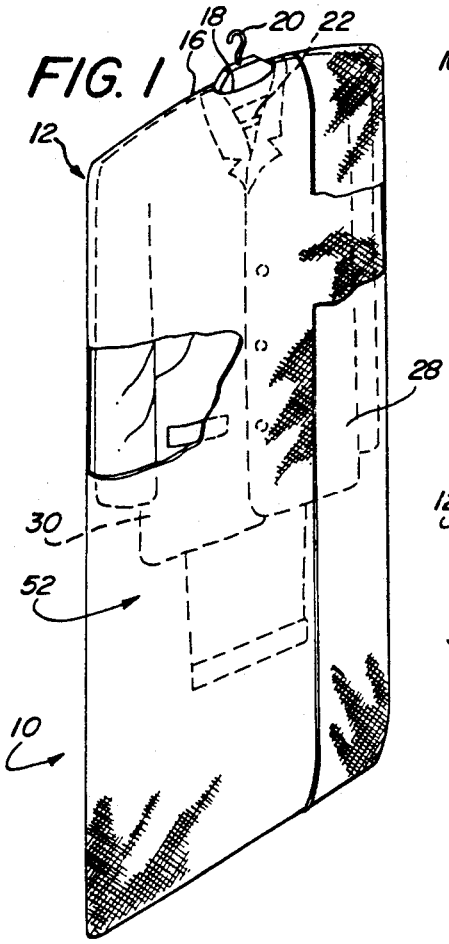
FIG. 1 is a perspective view of the first embodiment of the garment protector of this invention made of a sheer fabric with a garment hung on a hanger inserted into the envelope structure of the protector.
Figure 8:
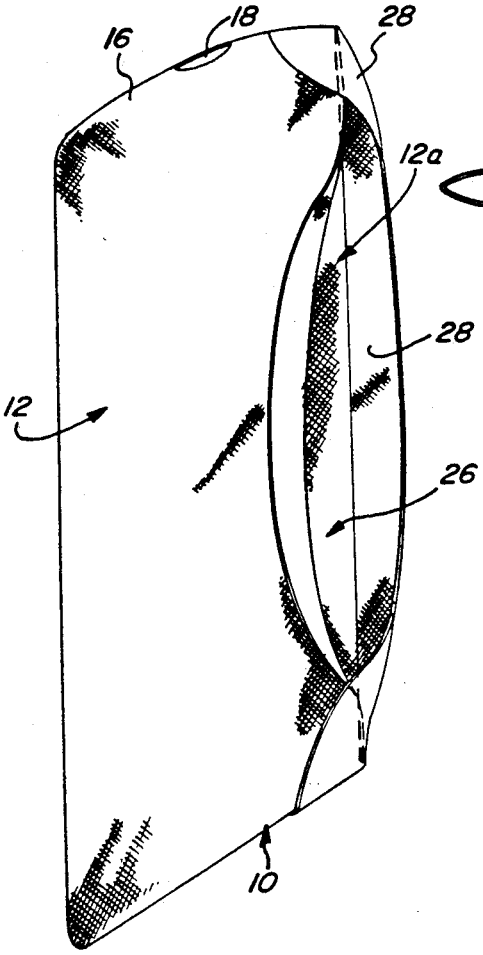
FIG. 8 is a perspective view of the garment protector of this invention showing the flap member of the envelope structure opened up to allow access to the interior of the envelope structure.
Figure 9:
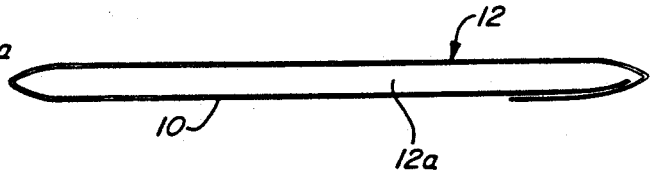
FIG. 9 is a cross-sectional view taken along line 9—9 of FIG. 2.
Figure 13:
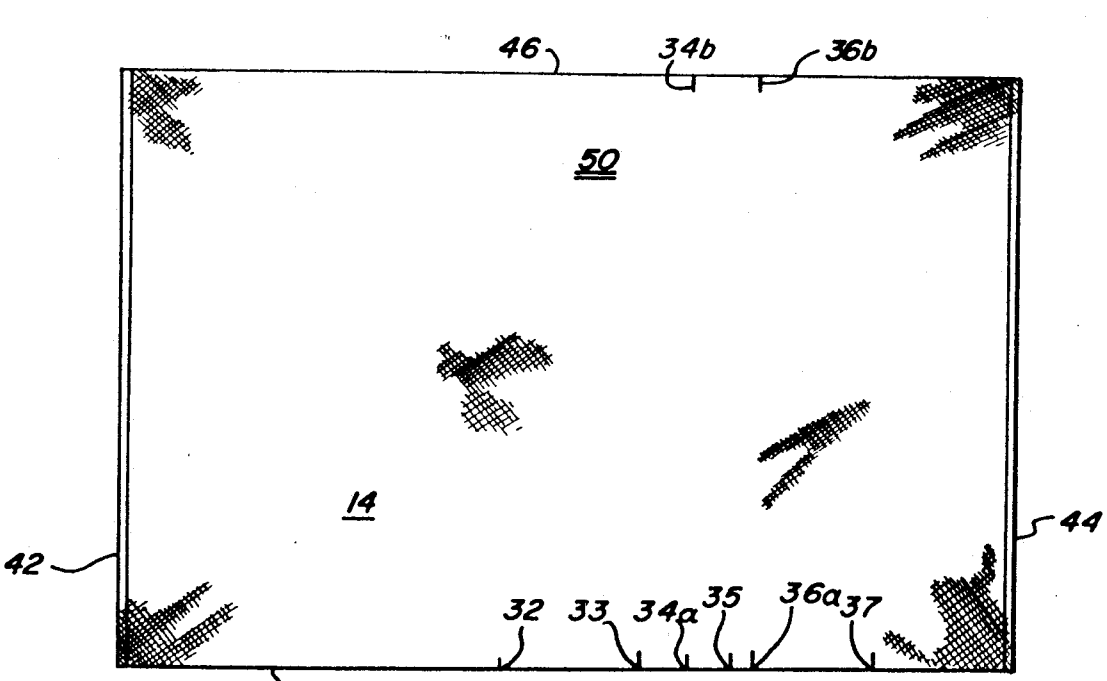
FIG. 13 is a plan view showing the unitary piece of cloth fabric from which the garment protector shown in FIGS. 1 through 9 is made.

The first embodiment of this invention, the garment protector 10, is illustrated in FIGS. 1 9. This garment protector 10 includes an envelope 12 which has a top edge 16 having a slit-like opening 18 in its central portion to allow the hook end 20 of a conventional coat hanger 22 to extend therethrough. The protector 10 is made of a sheer cloth fabric 14 (FIG. 13). The envelope 12 has a width about equal to the width of the hanger 22. Thus, the width of the protector for adult sizes ranges between about 18 and 26 inches, preferably about 21 inches. The width of the protector for children sizes ranges between about 7 and 18 inches, preferably about 9–10 inches. The length of the envelope 12 varies depending on the type of garment which it is designed to contain. Typically, this length will range between about 15 and about 60 inches. Along one longitudinal side edge 24 of the envelope 12 is an elongated slit-like opening 26 (FIG. 8) which is covered by a flap 28. The flap 28 is preferably from two to ten inches in width. This flap is pulled back, as illustrated in FIG. 8, to allow one to insert a garment 30 hung on the hanger 22 into the interior 12*a* of the envelope 12 with the hook end 20 of the hanger 22 being inserted in the slit-like central opening 18 in the top edge 16.

Because the protector 10 is made of a fabric rather than plastic, it is of higher quality than the covers made of plastic. To offset the additional cost associated with making the protector 10 of fabric, the manufacturing method is very simple and is illustrated in FIGS. 13–16. According to the manufacturing method of this invention, a unitary piece of fabric 14 is employed which has a width of about 47 inches (for adult sizes) and is cut to the desired length as is required by the length of the garment 30 to be stored within the envelope 12. Preferably, the fabric 14 is shear so that one may view a garment contained within the envelope 12.

In accordance with the manufacturing method of this invention, the fabric 14 is placed on a cutting table and a series of notches 32–37 are cut into the leading edge 40. The location of these notches 32–37 indicate to the seamstress how the fabric 14 should be folded and then sown. The selvaged edges 42 and 44 of the fabric 14 are not trimmed, thus providing a cost savings. There are notches 34*a* and 34*b* that lie along the central longitudinal axis of the protector 10, with two notches 33 and 35 on either side of the central notch 34*a* approximately one to two inches from this center notch 34*a*. The distance between these two notches 33 and 35 corresponds to the width of the slit-like opening 18 through which the hanger hook end 20 will pass. There is a notch 36*a* approximately 5½ inches from the central notch 34*a*. A notch 36*b* along the trailing edge 46 is displaced 5½ inches from the central notch 34*b*. These 5½ offset notches 36*a* and 36*b* indicate to the seamstress where the right. hand selvage edge 44 should be folded over and aligned to form the flap 28. The notch 37 corresponds to the longitudinal side edge 24 of the envelope 12.

Figure 14:
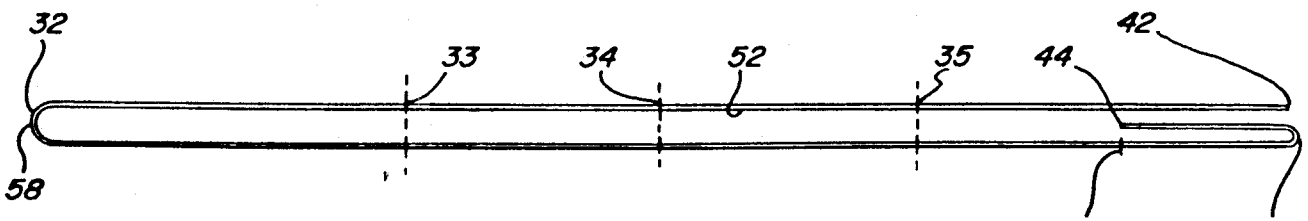
FIG. 14 is an end view of the fabric shown in FIG. 13 after being folded during manufacture of the garment protector.

Working with the wrong side 50 of the fabric 14 facing the seamstress, the seamstress folds the fabric, as indicated in FIG. 14, to bring the right-hand selvaged edge 44 into alignment with the notches 36*a* and 36*b*. Then the seamstress folds over what will be the front panel 52 of the protector 10 about the notch 32 to bring the selvage edge 42 to meet the side edge 24 and form a fold 58.

Figure 15:
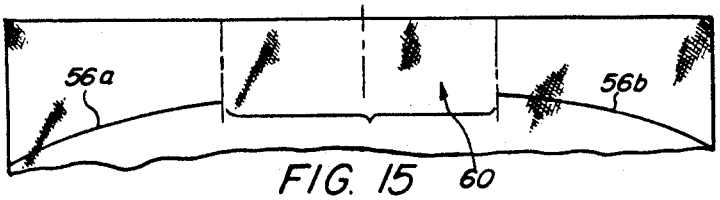
FIG. 15 is a fragmentary plan view showing how the top portion of the folded fabric shown in FIG. 14 is sown.

As shown in FIG. 15, with the fabric 14 folded as illustrated in FIG. 14, the seamstress sows along curve lines to make a segmented seam 56, having segments 56*a* and 56*b*. Seam segment 56*a* begins at the fold 58 (FIG. 14), extending inwardly terminating below and adjacent the notch 33, about ¾ of an inch from this notch 33. The seam segment 56*a* is initiated about 3¼ inches from the leading 40 edge and then discontinued when the notch 33 is reached, about ¾ inch inwardly from this notch 33. The seamstress then pulls the folded fabric 14 past the sewing needle (not shown) without the sewing machine operational to create a gap 60 in the seam 56. This gap 60 corresponds in width to the slit-like opening 18. The seamstress resumes sewing to form the seam segment 56*b* about ¾ inch from the leading edge 40 inwardly from the notch 35, moving the tread downwardly on a curve, terminating at about 3¼ inch from the leading edge 40.

Figure 16:
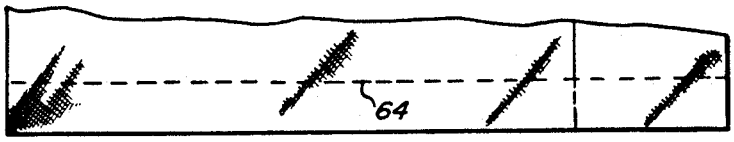
FIG. 16 is a fragmentary plan view showing how the bottom portion of the folded fabric shown in FIG. 14 is sown.

As shown in FIG. 16, the seamstress then forms a hem 64 along the bottom of the folded fabric. This hem 64 is more or less a straight line about ¾ inch from the trailing edge 46. The seamstress then folds back the fabric section 14*a* (FIG. 15) adjacent the gap 60 and presses this folded back fabric section 14*a*. The seamstress next trims away excess fabric adjacent to seam segments 56*a* and 56*b* and any threads and reverses the envelope 12 so that the right side 51 (FIG. 1) of the fabric 14 is presented to view.

Figure 2:
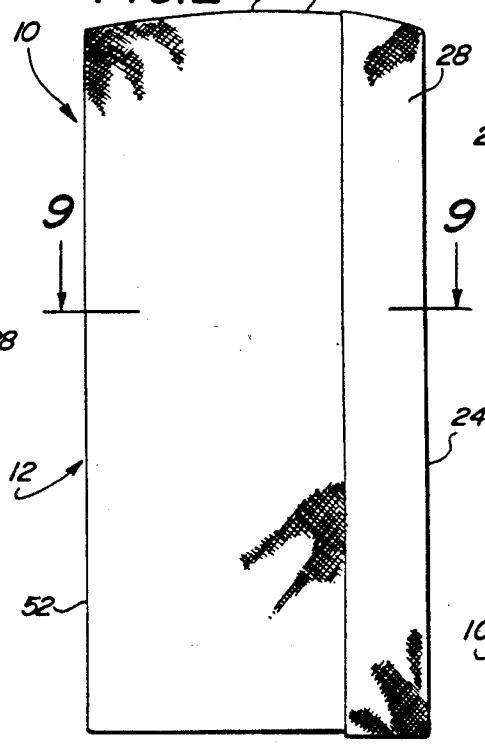
FIG. 2 is a front elevational view of the garment protector of this invention.
Figure 3:
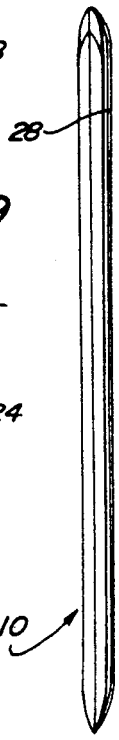
FIG. 3 is an end view looking at the garment protector from the right hand side as viewed in FIG. 2.
Figure 4:
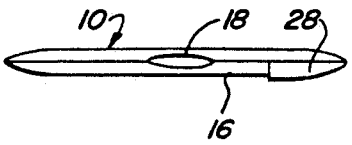
FIG. 4 is a top plan view of the garment protector shown in FIG. 2.
Figure 5:
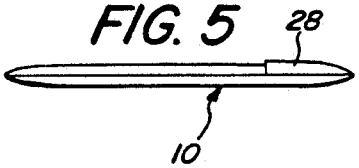
FIG. 5 is a bottom plan view of the garment protector shown in FIG. 2.
Figure 6:
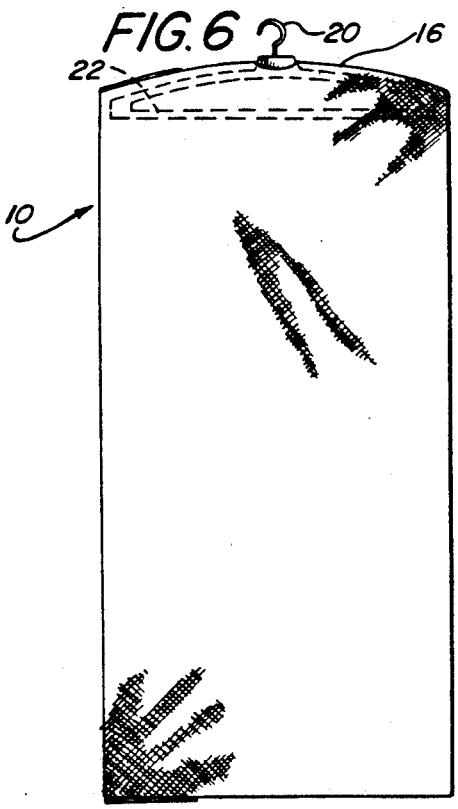
FIG. 6 is a rear elevational view of the garment protector shown in FIG. 2.
Figure 7:
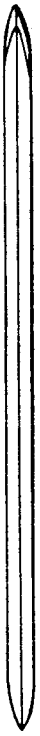
FIG. 7 is an end view looking at the garment protector shown in FIG. 6 from the right hand end.
Figure 12:
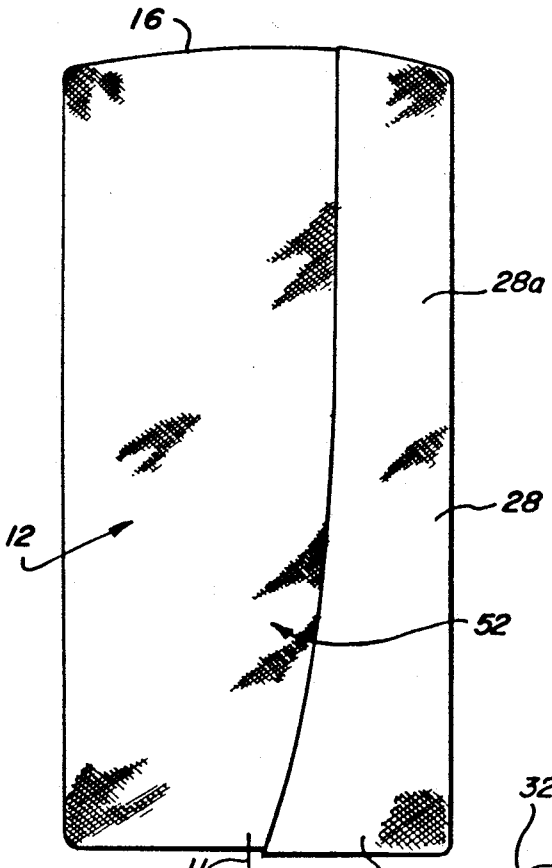
FIG. 12 is a front view of the third embodiment of the garment protector of this invention.

FIG. 12 illustrates the second embodiment of this invention, protector 12, wherein the flap 28 is on a curved bias rather than a straight line as shown in FIG. 2. The top 28*a* of the flap 28 has a width of about 3.6 inches and the bottom 28*b* has a width of about 5–9 inches. The bottom 28*b* of the flap 28 is inside the center line 11 of the protector 12.

Figure 10:
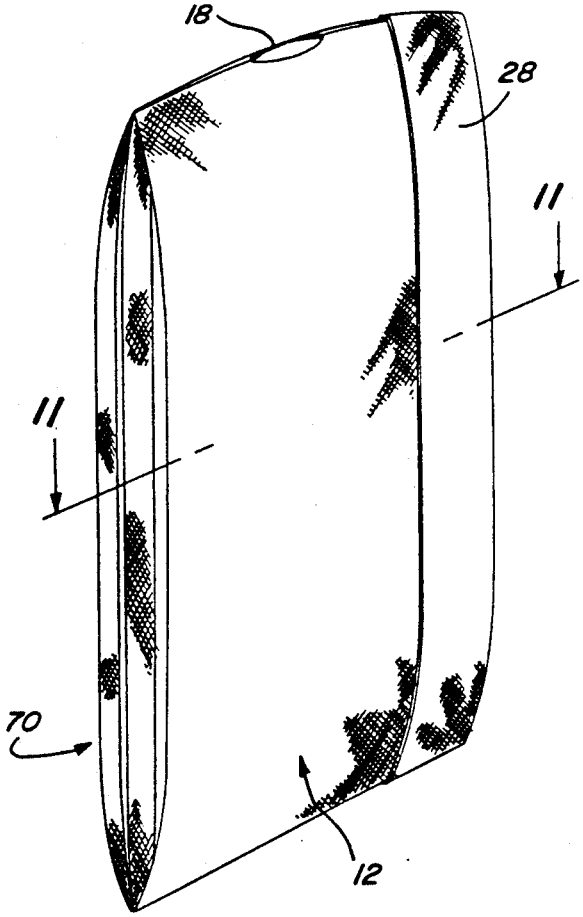
FIG. 10 is a perspective view of the second embodiment of the garment protector of this invention.
Figure 11:
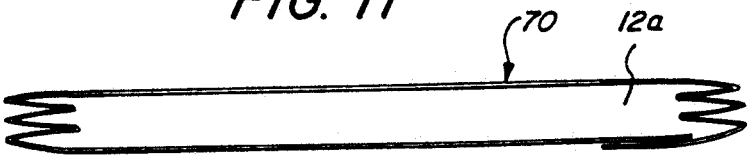
FIG. 11 is a cross-sectional view taken along line 11—11 of FIG. 10.

FIGS. 10 and 11 illustrate the third embodiment of this invention showing a garment protector 70 with pleats 72 along its longitudinal side edges. The longitudinal side edges are of about equal length, with only one of the side edges being open. Each of the side edges have a pleat therein. The way this pleated garment protector 70 is made is illustrated in FIGS. 17–20.

Figure 17:
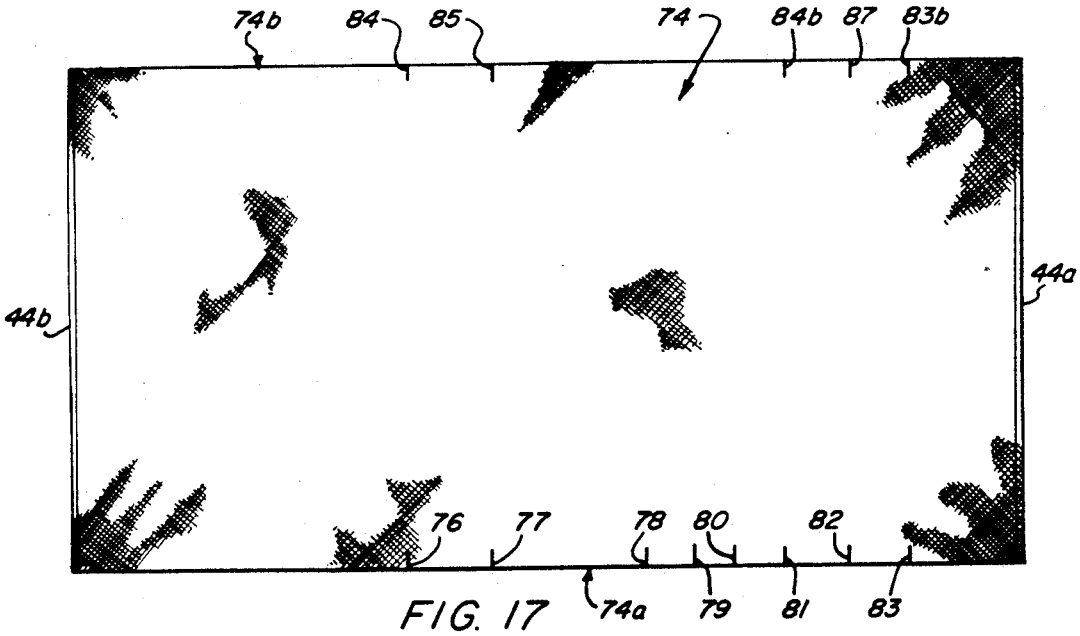
FIG. 17 is a plan view of a piece of cloth fabric from which the garment protector shown in FIGS. 10 and 11 is made.

The garment protector 70 is made from a unitary piece of cloth fabric 74 (FIG. 17). The width of this fabric 74 ranges between about 57 and 60 inches (adult sizes) or between about 30 and about 48 inches (children sizes) and the salvage edges 44*a* and 44*b* are not trimmed, thereby, providing a cost-saving. The length of the fabric is selected on the basis of the length of the protector desired.

First, notches 79*a* through 87*a* are cut into the leading edge 74*a* as indicated, and then, notches 79*b* through 87*b* generally in alignment with the notches 79*a* and 87*a* are cut into the trailing edge 74*b* of the fabric 74. The notch groups 79*a*–83*a* and 79*b*–87*b* are used to assist the seamstress to fold correctly the fabric 74 to create the pleat on the right hand side of the protector 70 as viewed in FIG. 10. The notch groups 84*a*–87*a* and 84*b*–87*b* are used to assist the seamstress to fold correctly the fabric 74 to create the pleat on the left hand side of the protector 70 as viewed in FIG. 10. The notches x, y, and z, and the notches x′, y′, and z′ are used by the seamstress to create the slit 18.

Figure 18:
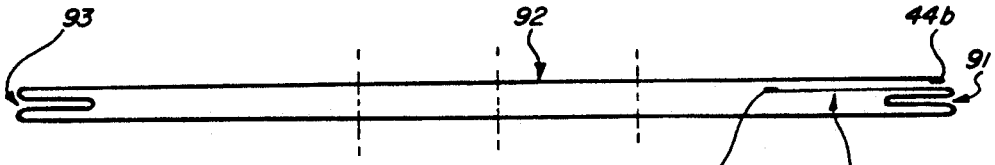
FIG. 18 is a end view showing how the fabric of FIG. 17 is initially folded during manufacture of the garment protector.
Figure 19:
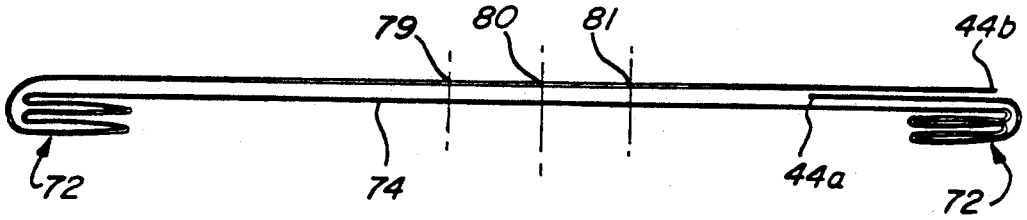
FIG. 19 is a end view showing how the fabric of FIG. 18 is folded a second time during manufacture of the garment protector.
Figure 20:
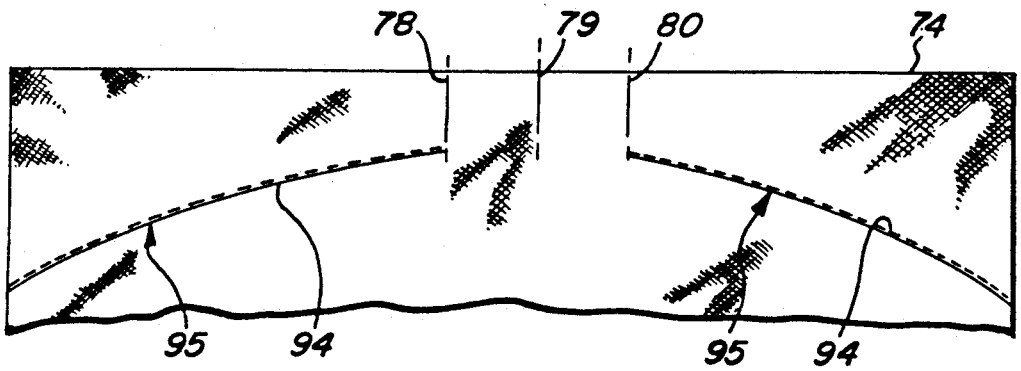
FIG. 20 is a fragmentary plan view showing how the top portion of the folded fabric of FIG. 19 is sown.

With the wrong side facing the seamstress, the seamstress first folds the salvage edge 44*a* inwardly to align it with the notches 79*a* and 79*b*, respectively in the leading and trailing edges 74*a* and 74*b*. As depicted in FIG. 18, the outer edge of an overlap section 90 thus created is then tucked inwardly to form a pleated portion 91. The pleated portion 91 has outer folds corresponding with the notches 80*a* and 82*a*, and has an inner fold corresponding with the notch 81*a*. Next, the other selvage edge 44*b* is folded inwardly, bringing this selvage edge into alignment with the notches 83*a* and 83*b* to create a body section 92 (FIG. 18). As depicted in FIG. 18, the outer edge of an overlap section thus created is then tucked inwardly to form a pleated portion 93. The pleated portion 93 has outer folds corresponding with the notches 84*a* and 86*a*, and has an inner fold corresponding with the notch 85*a*. The notches x, y, and z, and the notches x′, y′, and z′ are now in registration as shown in FIGS. 18 and 19. The pleated portions 91 and 93 are then folded inwardly to create the pleats 72 as illustrated in FIG. 19. The fabric is now folded is now illustrated in FIG. 20.

The seamstress now sews the segmented seam 95 along the top portion of the folded fabric 74, essentially in the same manner as done in connection with the unpleated protector 10 to create a segmented seam 95, including segments 95*a* and 95*b*, lying along a curved line 94. Starting at about 3¼ inches below the leading edge 74*a* the segment 95*a* is formed with its inside end 97*a* terminating at about ¾ of an inch below the notches z,z'. The seamstress then lifts the needle (not shown) and replaces against the fabric 74 ¾ of an inch below the notches y,y' and starts to sew the seam segment 95*b* at the inside end 97*b*. The seam segment 95*b* follows along the curved line 94 to the folded edge of the seamstress next goes to the lower portion of the folded fabric 74 and sews a straight seam along the trailing edge 74*b* about ¾ of an inch from the bottom of the trailing edge. The seamstress then trims off excess material as before, and then reverses the garment protector 70 so that the right side of the fabric is presented to view.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. The above description also. This invention is, however, susceptible to modifications and alternate constructions from that discussed above which are fully equivalent. Consequently, it is not the intention to limit this invention to the particular embodiment disclosed. On the contrary, the intention is to cover all modifications and alternate constructions coming within the spirit and scope of the invention as generally expressed by the following claims:

I claim:

1. A method of making a garment protector which has an envelope structure and a flap member covering an open side edge in the envelope structure, said flap member being movable manually between a closed position covering the open side edge and overlying the envelope structure and an open position exposing the open side edge to allow a garment on a hanger to be placed into the envelope structure with the hook of the hanger extending outwardly through a slit in a top edge of the protector, said method including providing a unitary piece of fabric having opposed selvage edges and trailing edge and leading edges having notches therein which serve as means to align the selvage edges when folded inwardly to create the envelope structure, one of said notches coinciding with the central longitudinal axis of the protector and being straddled by a pair of notches which are spaced apart a distance corresponding to the width of the slit that allows the hook of the hanger to pass therethrough, folding the fabric inwardly upon itself to create the flap member, and sewing the folded fabric along its trailing and leading edges to form seams which form and close the envelope structure, one of said seams being segmented having a gap between the inside ends of the segmented seam which corresponds approximately in width to the slit that allows the hook end of the hanger to pass therethrough.

2. The method of claim 1 wherein during folding pleats are formed.

3. The method of claim 1 wherein the protector is made with the wrong side facing the seamstress and then it is reverse to expose the right of the fabric.

* * * * *